US005415984A

United States Patent [19]

Komamura et al.

[11] Patent Number: 5,415,984

[45] Date of Patent: May 16, 1995

[54] IMAGE FORMING ELEMENT

[75] Inventors: Tawara Komamura; Noritaka Nakayama; Toshihisa Takeyama; Norio Miura, all of Hino, Japan

[73] Assignee: Konica Corporation, Tokyo, Japan

[21] Appl. No.: 228,744

[22] Filed: Apr. 18, 1994

[30] Foreign Application Priority Data

Apr. 23, 1993 [JP] Japan ..... 5-098091

[51] Int. Cl.[6] ..... G03C 1/00; G03C 3/00

[52] U.S. Cl. ..... 430/495; 430/936; 430/270; 430/332; 430/346

[58] Field of Search ..... 430/495, 936, 270, 332, 430/346

[56] References Cited

U.S. PATENT DOCUMENTS

| | | | |
|---|---|---|---|
| 4,124,392 | 11/1978 | Adin et al. | 430/936 |
| 4,201,588 | 5/1980 | Adin et al. | 430/936 |
| 4,243,737 | 1/1981 | DoMinh | 430/936 |
| 4,292,399 | 9/1981 | Adin | 430/936 |
| 4,294,912 | 10/1981 | Adin et al. | 430/936 |
| 4,314,019 | 2/1982 | Adin et al. | 430/936 |
| 4,324,852 | 4/1982 | Adin et al. | 430/936 |
| 4,334,005 | 6/1982 | Adin et al. | 430/936 |
| 4,421,846 | 12/1983 | Ikeuchi et al. | 430/936 |
| 4,460,682 | 7/1984 | Mizukura et al. | 430/936 |
| 4,954,414 | 9/1990 | Adair et al. | 430/936 |
| 4,968,586 | 11/1990 | DoMinh | 430/936 |

FOREIGN PATENT DOCUMENTS

| | | |
|---|---|---|
| 57-139739 | 8/1982 | Japan . |
| 59-95529 | 6/1984 | Japan . |

*Primary Examiner*—Charles L. Bowers, Jr.
*Assistant Examiner*—Geraldine Letscher
*Attorney, Agent, or Firm*—Frishauf, Holtz, Goodman & Woodward

[57] ABSTRACT

An image forming element utilizing the photoreduction of a cobalt complex is disclosed. The image forming element comprises a support having thereon a layer comprising a cobalt complex compound represented by Formula 1 or Formula 2;

(1)

wherein lig is a coordinating compound capable of forming a cobalt complex compound with a cobalt cation; $R^1$, $R^2$, $R^3$ and $R^4$ are each independently an aryl group, an alkyl group, an alkenyl group, an alkynyl group, a cycloalkyl group, an aralkyl group, a heterocyclic group or a cyano group, provided that at least one of $R^1$, $R^2$, $R^3$ and $R^4$ is an alkyl group, an alkenyl group, an alkynyl group, a cycloalkyl group, an aralkyl group, a heterocyclic group or a cyano group, the above groups represented by $R^1$, $R^2$, $R^3$ or $R^4$ are each may have a substituent; X is a monovalent or bivalence anion; m is 1, 2 or 3, when m is 2 or 4, a plurality of lig may be the same or different; n is 2 or 3; and s is 0, 1 or 2; and m, n and s are selected so as the valence of the cobalt complex compound to be zero;

(2)

wherein Dlig is a coordination compound capable of forming a cobalt complex compound with a cobalt cation; p is 1, 2 or 3, when p is 2 or 3 a plurality of Dlig may be the same or different, provided that at least one of Dlig is a coodination compound having a moiety of a dye or a moiety of a dye precuror; $R^5$, $R^6$, $R^7$ and $R^8$ are each independently an aryl group, an alkyl group, an alkenyl group, an alkynyl group, a cycloalkyl group, an aralkyl group, a heterocyclic group or a cyano group, groups represented by $R^5$, $R^6$, $R^7$ and $R^8$ each may have a substituent; q is 1, 2 or 3; X is a monovalent or bivalent; r is 0, 1 or 2; and p, q and r are selected so that the valence of the cobalt complex compound to be zero.

21 Claims, No Drawings

IMAGE FORMING ELEMENT

FIELD OF THE INVENTION

This invention relates to a novel image-forming element and, particularly to an image-forming element utilizing the photoreduction reaction of a cobalt complex.

BACKGROUND OF THE INVENTION

As for an image-forming element utilizing a cobalt complex, there are known elements including those described in, for example, Japanese Patent Publication Open to Public Inspection (hereinafter referred to as JP OPI Publication) Nos. 50-139722/1975, 50-139723/1975 and 50-139724/1975. Those elements described therein are excellent in such a point that an image can be formed in a relatively simple dry process. However, the light-sensitivity of such a cobalt complex as mentioned above is so limited in itself that it can only be light-sensitive to rays of light having a wavelength shorter than 300 nm. In an image-forming element such as those described in the above-given publications, therefore, a photoinduced reducing agent such as a naphthoquinone derivative and a sensitizer is used as a light-sensitive substance, so that the light-sensitive elements are provided, by the functions of the photoinduced reducing agent, with a sensitivity to rays of light having the wavelengths than 300 nm. However, it cannot be said that the sensitivity thereof is satisfactorily high and, further, those light-sensitive elements have the defect that the preservability of the elements deteriorates when spectrally sensitizing them to a long wavelength of light, and that a stain is produced by a photoinduced reducing agent after forming an image. In addition to the above, those light-sensitive elements are limited to their own application, because, when making an exposure, a scanning-exposure by a semiconductor laser beam cannot be applied which has remarkably been developed in recent years. JP OPI Publication No. 59-95529/1984 discloses a method in which a silver salt capable being dry-processed is used with a cobalt complex for making a sensitivity higher. However, the above-mentioned dry-process has the defect that a stain produced by a developer for a silver salt, because, in this method, an image is produced so that a dye is so released as to meet the development of the silver salt.

As for the other image-forming elements each utilizing a cobalt complex, JP OPI Publication No. 57-139739/1982 discloses a light-sensitive element utilizing the borate complex of cobalt, and JP OPI Publication No. 2-182701/1990 discloses another light-sensitive element containing a complex comprising a cation of a transition metal including cobalt and a borate anion. The former complicates the process thereof, because development is carried out with an ordinary silver halide photographic color-developer. The latter is subjected to a copolymerization process for forming an image, and is not preferable to obtain an image having a contrast gradation.

SUMMARY OF THE INVENTION

An object of the invention is to provide a element, in a simple dry-process, that is capable of providing a high sensitivity, recording an image with multicontrast gradation, and forming the image excellent in preservation.

Another object of the invention is to provide an image-forming element capable of forming a stable image.

A further object of the invention is to provide an image-forming element capable of being exposed to rays of light having a wavelength not shorter than 500 nm and having a high sensitivity.

The image forming element of the invention comprises a support having thereon a layer comprising a cobalt complex compound represented by Formula 1 or Formula 2;

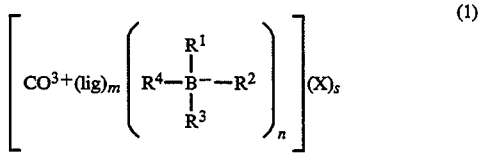

(1)

wherein lig is a coordination compound capable of forming a cobalt complex compound with a cobalt cation; $R^1$, $R^2$, $R^3$ and $R^4$ are each independently an aryl group, an alkyl group, an alkenyl group, an alkynyl group, a cycloalkyl group, an aralkyl group, a heterocyclic group or a cyano group, provided that at least one of $R^1$, $R^2$, $R^3$ and $R^4$ is an alkyl group, an alkenyl group, an alkynyl group, a cycloalkyl group, an aralkyl group, a heterocyclic group or a cyano group, the above groups represented by $R^1$, $R^2$, $R^3$ or $R^4$ are each may have a substituent; X is a monovalent or bivalence anion; m is 1, 2 or 3, when m is 2 or 4, a plurality of lig may be the same or different; n is 2 or 3; and s is 0, 1 or 2; and m, n and s are selected so as the valence of the cobalt complex compound to be zero;

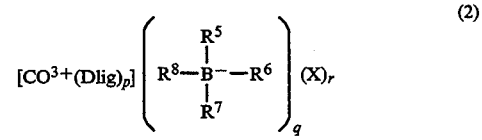

(2)

wherein Dlig is a coordination compound capable of forming a cobalt complex compound with a cobalt cation; p is 1, 2 or 3, when p is 2 or 3 a plurality of Dlig may be the same or different, provided that at least one of Dlig is a coodination compound having a moiety of a dye or a moiety of a dye precursor; $R^5$, $R^6$, $R^7$ and $R^8$ are each independently an aryl group, an alkyl group, an alkenyl group, an alkynyl group, a cycloalkyl group, an aralkyl group, a heterocyclic group or a cyano group, the groups represented by $R^5$, $R^6$, $R^7$ and $R^8$ each may have a substituent; q is 1, 2 or 3; X is a monovalent or bivalent; r is 0, 1 or 2; and p, q and r are selected so that the valence of the cobalt complex compound to be zero.

DETAILED DESCRIPTION OF THE INVENTION

The cobalt complex compounds each represented by the above-given Formulas 1 and 2, (hereinafter referred to as a cobalt complex of the invention), will now be further detailed.

In Formula 1, at least one of $R^1$ through $R^4$ is an alkyl, aralkyl, alkenyl, alkynyl, cycloalkyl, heterocyclic or cyano group, each of which may have a substituent. Among them, an alkyl group and an aralkyl group are preferred from the viewpoint of raising a sensitivity and, when $R^1$ is an alkyl or aralkyl group and $R^2$ through $R^4$ are each an aryl or heterocyclic group, it is particularly preferred.

The typical examples of $R^1$ through $R^4$ include the following groups.

The above-mentioned alkyl groups include, for example, a straight-chained or branched alkyl group, such as methyl ethyl, butyl, isobutyl, hexyl, octyl and stearyl. As for the alkenyl groups, those having 2 to 20 carbon atoms are preferred. As for the alkynyl groups, those having 2 to 20 carbon atoms are preferred. As for the cycloalkyl group, those having a 5- to 7-membered ring. As for the aralkyl groups, a benzyl group is preferred.

The heterocyclic groups include, preferably, a heterocyclic group having an aromaticity, such as a thiophene group. As for the aryl groups, a phenyl or naphthyl group is preferred.

Those groups may further be substituted. The substituents thereto include, for example, a halogen atom and each of the groups of cyano, nitro, alkyl, aryl, hydroxy, amino including an alkyl-substituted amino group, alkoxy, carbamoyl, and —$COOR^9$ and $OCOR^9$, in which $R^9$ represents an organic group such as an alkyl or aryl group.

"lig" represents a coordination compound capable of forming a complex with cobalt cation. In a cobalt complex, the cobalt cation is of a Lewis acid, and the coordinating compound is of a Lewis base. Almost every Lewis base can be used in a coordination compound. From the viewpoints of the stability of a cobalt complex and a post-reduction reaction acitivity, a bi- or tri-dentate ligand is preferred. For example, those ligands include an amine, such as ethylene diamine, diethylene triamine, triethylene tetramine and diaminodiacetate, dipyridine, glyoximine, β-diketone, a coordination compound used in the exemplified cobalt complex compounds, and those given in JP OPI Publication No. 59-95529/1984.

In Formula 2, at least one of the groups represented by $R^5$ through $R^8$ represents an alkyl or aralkyl group, that is preferred from the viewpoint of raising a sensitivity. And, it is particularly preferred when $R^5$ represents an alkyl or aralkyl group and $R^6$ through $R_8$ represent each an aryl or heterocyclic group.

The typical examples of $R^5$ through $R^8$ of Formula 2 include the following groups.

The above-mentioned alkyl groups include, for example, a straight-chained or branched alkyl group, such as methyl ethyl, butyl, isobutyl, hexyl, octyl and stearyl. As for the alkenyl groups, those having 2 to 20 carbon atoms are preferred. As for the alkynyl groups, those having 2 to 20 carbon atoms are preferred. As for the cycloalkyl group, those having a 5- to 7-membered ring. As for the aralkyl groups, a benzyl group is preferred.

The heterocyclic groups include, preferably, a heterocyclic group having an aromaticity, such as a thiophene group. As for the aryl groups, a phenyl or naphthyl group is preferred.

Those groups may further be substituted. The substituents thereto include, for example, a halogen atom and each of the groups of cyano, nitro, alkyl, aryl, hydroxy, amino including an alkyl-substituted amino group, alkoxy, carbamoyl, and —$COOR^9$ and $OCOR^9$, in which $R^9$ represents an organic group such as an alkyl or aryl group.

Further, at least one of Dlig(s) is a coordinated compound containing a dye moiety or a dye precursor moiety. A coordinated compound containing a dye moiety means a dye, that is a coordinated compound itself, i.e., that contains a coordination bonding atom as a part constituting the dye, or a dye having a group, as a substituent, capable of forming a coordination-bond. Such compound having a dye moiety or dye precursor moiety is preferred from such a viewpoint that a spectral sensitization can be performed so as to be sensitive to the spectral region from visible rays of light to infrared rays of light by selecting a dye as a coordination compound, and that a dye image can be formed by releasing a dye or a dye precursor serving as a coordination compound. At least one of plural coordination compounds has a dye moiety or a dye precursor moiety, however, the other coordination compounds may contain a dye or dye precursor moiety or may not contain any dye portion.

The amounts of a cobalt complex of the invention to be added may be varied according to the kinds and application modes thereof. However, it is preferred to add in an amount within the range of 0.01 to 5 g per $m^2$ of a an image forming element to be used therein.

The concrete examples of a cobalt complex Formula 1 or 2 of the invention include the following compounds. Those compounds may be synthesized with reference to the descriptions on pages 6 to 8 of JP OPI Publication No. 59-95529/1984.

| Complex No. | $R^1$ | $R^2$ | $R^3$ | $R^4$ |
|---|---|---|---|---|
| | $CO^{3+}(NH_2CH_2CH_2NH_2)_3\left(R^4-\overset{\overset{R^1}{\vert}}{\underset{\underset{R^3}{\vert}}{B}}-R^2\right)_3$ | | | |
| 1 | $-C_4H_9$ | 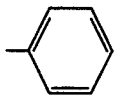 | 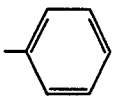 | 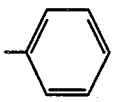 |
| 2 | $-C_4H_9$ | $-C_4H_9$ | $-C_4H_9$ | $-C_4H_9$ |
| 3 | $-C_4H_9$ | 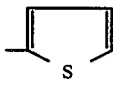 | 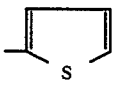 | 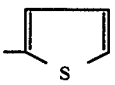 |

-continued

| | | | | |
|---|---|---|---|---|
| 4 | $-C_4H_9(i)$ | 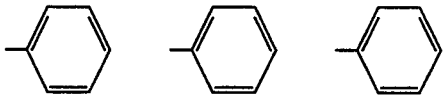 | | |
| 5 | 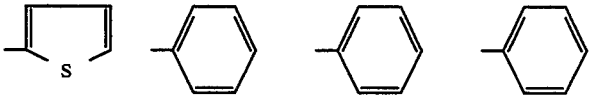 | | | |
| | $CO^{3+}(NH_2CH_2CONH_2)_3\left(R^4-\overset{\overset{R^1}{\vert}}{\underset{\underset{R^3}{\vert}}{B}}-R^2\right)_3$ | | | |
| 6 | $-C_4H_9$ | 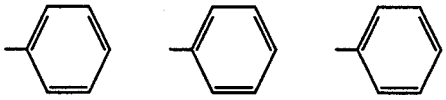 | | |
| 7 | $-C_4H_9$ | 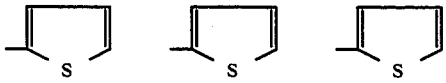 | | |
| | $CO^{3+}(NH_2CH_2CH_2NHCH_2CH_2NH_2)_3\left(R^4-\overset{\overset{R^1}{\vert}}{\underset{\underset{R^3}{\vert}}{B}}-R^2\right)_3$ | | | |
| 8 | $-C_4H_9$ | 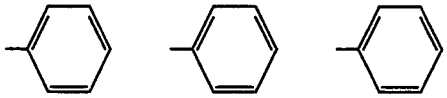 | | |
| 9 | $-C_4H_9$ | $-C_4H_9$ | $-C_4H_9$ | $-C_4H_9$ |
| 10 | $-C_4H_9(i)$ | 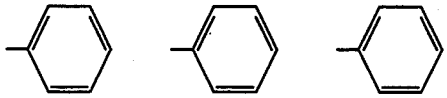 | | |
| 11 | 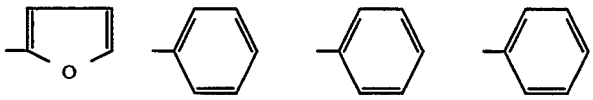 | | | |
| | $CO^{3+}\left(\text{N}\!-\!\text{C}_5\text{H}_4\!-\!\text{C}_5\text{H}_4\!-\!\text{N}\right)_3\left(R^4-\overset{\overset{R^1}{\vert}}{\underset{\underset{R^3}{\vert}}{B}}-R^2\right)_3$ | | | |
| 12 | $-C_4H_9$ | 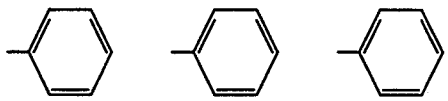 | | |
| 13 | $-C_4H_9$ | $-C_4H_9$ | $-C_4H_9$ | $-C_4H_9$ |
| 14 | $-C_4H_9$ | 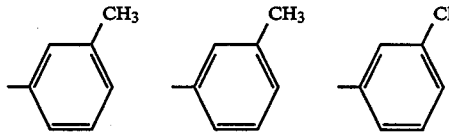 | | |

-continued
| | | | | |
|---|---|---|---|---|
| 15 | 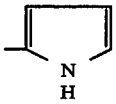 | 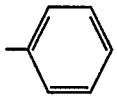 | 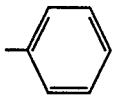 | 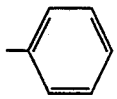 |
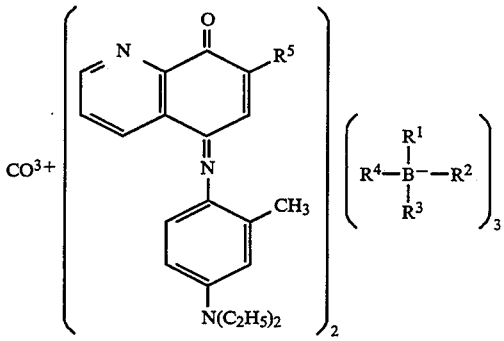
| Complex No. | $R^5$ | $R^1$ | $R^2$ | $R^3$ | $R^4$ |
|---|---|---|---|---|---|
| 16 | H | $-C_4H_9$ | 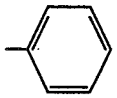 | 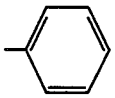 | 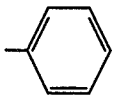 |
| 17 | H | $-C_4H_9$ | $-C_4H_9$ | $-C_4H_9$ | $-C_4H_9$ |
| 18 | H | $-C_4H_9$ | 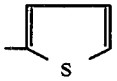 | 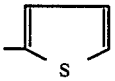 | 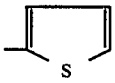 |
| 19 | H | $-C_4H_9(i)$ | 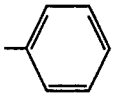 | 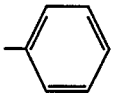 | 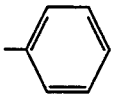 |
| 20 | $-NHCOCH_3$ | $-C_4H_9$ | 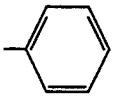 | 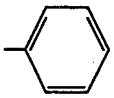 | 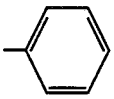 |
| 21 | Cl | $-C_4H_9$ | 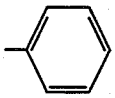 | 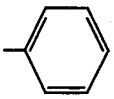 | 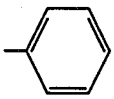 |
| 22 | $-NHCOC_{17}H_{35}$ | $-C_4H_9$ | 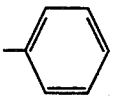 | 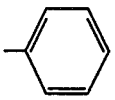 | 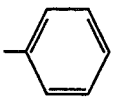 |
| Complex No. | $R^1$ | $R^2$ | $R^3$ | $R^4$ |
|---|---|---|---|---|
| $CO^{3+}(NH_2CH_2CH_2NH_2)_2NH_2CH_2CH_2NH$ 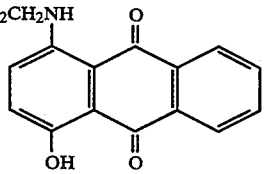 | | | | 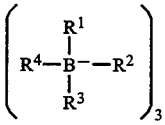 |
| 23 | $-C_4H_9$ | 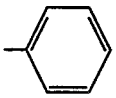 | 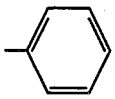 | 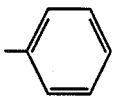 |
| 24 | $-C_4H_9$ | $-C_4H_9$ | $-C_4H_9$ | $-C_4H_9$ |

-continued

| | | | | |
|---|---|---|---|---|
| 25 | $-C_4H_9$ | 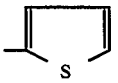 | 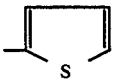 | 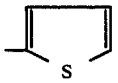 |
| 26 | $-C_4H_9(i)$ | 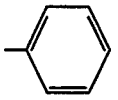 | 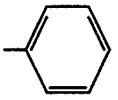 | 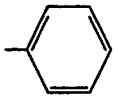 |
| | 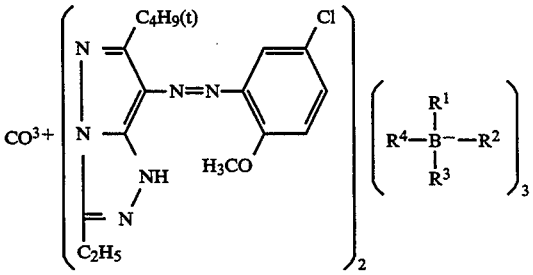 | | | |
| 27 | $-C_4H_9$ | 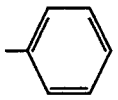 | 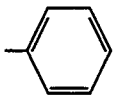 | 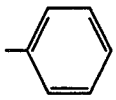 |
| 28 | $-C_4H_9$ | $-C_4H_9$ | $-C_4H_9$ | $-C_4H_9$ |
| 29 | $-C_4H_9$ | 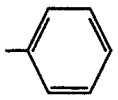 | 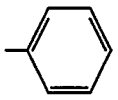 | 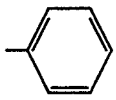 |
| 30 | $[Co^{3+}(NH_2CH_2CH_2NH_2)_3](BuB^-Ph_3)_2Cl^-$ | | | |
| 31 | $[Co^{3+}(NH_2CH_2CH_2NH_2)_3](BuB^-Ph_3)(CF_3COO^-)_2$ | | | |

In the above complex 30 and 31, Bu is a butyl group and Ph is a phenyl group.

In a preferred embodiment of an image-forming element of the invention, an image-forming element comprises a support bearing thereon a light-sensitive layer comprising a cobalt complex compound of the invention and a binder and, if required, a compound capable of forming a complex together with a cobalt cation, hereinafter referred to as a ligand-exchanging agent, is further added to the light-sensitive layer or another layer.

A ligand-exchanging agent means a compound capable of accelerating the release of a coordination compound from a cobalt complex upon making reaction with a reduced cobalt complex so as to meet an exposure and, in other words, a compound capable of forming at least a double-dentate chelate. The concrete examples of the above-mentioned ligand-exchanging agents include the compounds given in JP OPI Publication No. 59-95529/1984, p. 10. Such a ligand-exchanging agents as mentioned above include, preferably, those of the substantially colorless type when a dye is contained as a coordination compound of a cobalt complex of the invention, and those of a chelate-forming compound containing a dye portion when any dye portion is not contained in a coordination compound of a cobalt complex.

A ligand-exchanging agent is added to the same layer containing a cobalt complex of the invention, or the different layer not containing any cobalt complex of the invention. The amount of a ligand-exchanging agent to be added thereto may be varied according to the constitutions and purposes of application of an image-forming element. However, it is added in a proportion, for example, within the range of 0.1 to 20 mol % to an amount of a cobalt complex of the invention to be added.

Some of the preferred ligand exchanging agents will typically been given below.

Ligand exchanging agent-1
$NH_2CH_2CH_2NH_2$

Ligand exchanging agent-2
$NH_2CH_2CONH_2$

Ligand exchanging agent-3

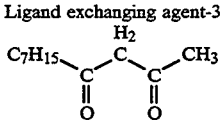

Ligand exchanging agent-4

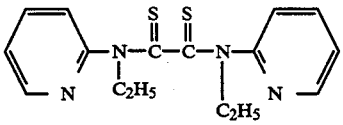

Ligand exchanging agent-5

-continued

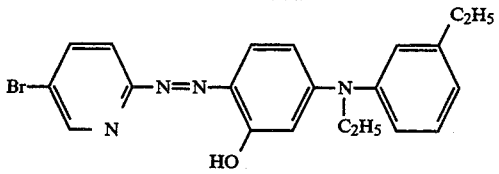

Ligand exchanging agent-6

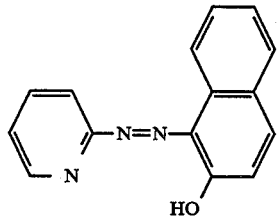

Ligand exchanging agent-7

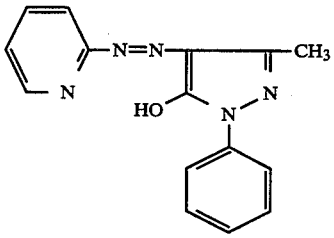

Ligand exchanging agent-8

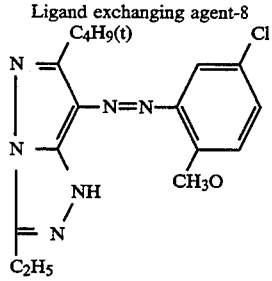

Ligand exchanging agent-9

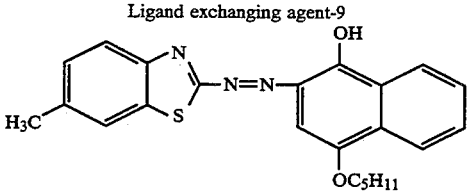

Ligand exchanging agent-10

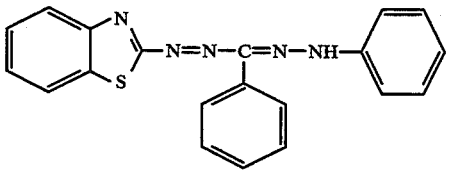

The above-mentioned binders include, preferably, a solvent-soluble polymer such as acrylic resin, methacrylic resin, polystyrene, polycarbonate, polysulfone, polyether sulfone, polyvinyl butyral, polyvinyl acetal, nitrocellulose and ethyl cellulose.

Those binders may be used not only, independently or in combination, by dissolving them in an organic solvent, but also in the form of a latex-dispersion.

An amount of a binder to be used is varied according to a single-layer structure or a multilayer structure so as to meet the application purposes of an image-forming material of the invention. However, it is preferable, in all cases, to use it in an amount within the range of 0.1 to 20 g per $m^2$ of a support used therein.

The above-mentioned light-sensitive layer can be formed in the following manner. A light-sensitive layer coating solution is prepared by dissolving, in a solvent, one or not less than two kinds of the cobalt complexes of the invention together with a binder, or by dispersing them in a solvent so as to be fine particles, and the resulting coating solution is coated on a support and is then suitably dried up. When a layer in which ligand exchanging agent is contained is provided, the layer can be formed identically with the light-sensitive layer except that the cobalt complex is omitted.

The dry thickness of the above.-mentioned light-sensitive layer is preferably within the range of 0.1 to 10 μm.

Any support of an image-forming element may selectively be used, provided that the dimensional stability and heat-resistance thereof are to be excellent in the course of carrying out a developing step. For example, an excellently heat-resistive and transparent plastic-made film and so forth may be used for. To be more concrete, they include those made of a polymer such as polyethylene terephthalate, polysulfone, polycarbonate and polyimide. It is preferred that the thickness of those supports are ordinarily within the range of 10 to 200 μm.

Now, preferable embodiments of an image-forming process using an image-forming element of the invention will be detailed below.

When an image-forming element is exposed imagewise to light, a cobalt complex is so reduced as to correspond to an exposure quantity. When the image-forming element is then heated preferably up to 50° to 150° C., a coordination compound is released from the reduced cobalt complex by the functions of a ligand-exchanging agent, so that the ligand-exchanging agent forms a cobalt complex. In this case and when a dye portion is contained in the coordination compound, a dye is released imagewise from the cobalt complex, and the distribution of the released dye is transferred onto an image-receiving sheet. Thereby, an image is formed on the image-receiving sheet, or an image is formed of a dye remaining on the image-forming material.

On the other hand, when a dye moiety is not contained in a coordination compound, a ligand-exchanging agent containing a dye is used. The ligand-exchanging agent containing a dye forms a cobalt cation and a complex upon making a reaction of the ligand-exchanging agent with the reduced cobalt complex and the ligand-exchanging agent containing the dye moiety imagewise is then immobilized. Thereafter, when transferring the ligand-exchanging agent containing an unreacted dye portion, an image comprising a ligand-exchanging agent containing a dye moiety is formed on an image-receiving sheet or an image-forming element. An image-transfer to the image-receiving sheet is carried out by heating, preferably up to 80° to 200° C., the image-receiving sheet and an image-forming material both put one upon another.

The above-mentioned image-transfer may be carried out at the same time when the image-receiving sheet and an image-forming material are heated for making a reaction with a ligand-exchanging agent, or the image-transfer may be made after completing the reaction. It is also allowed to form an image without transferring any dye, but by utilizing the difference between the color of the cobalt complex of a dye and the color of a dye not cobalt-complexed. An image formed on the image-receiving element by the process of the invention is stable after prolonged storage.

As for an image-receiving element, those comprising a support bearing an image-receiving layer thereon may be used, which include image-receiving elements commonly used as thermal transfer image-receiving element.

An image-receiving element applicable thereto include, for example, those made of paper, plastic film or a paper-plastic film composite material. To be more concrete, they include such a support as those given in JP OPI Publication No. 3-54556/1992, p.5, 17th line in the upper-right column to 11th line in the lower-left column.

The above-mentioned image-receiving layer comprises a polymer binder. Thermoplastic polymers are preferred for the polymer binders and they include, for example, polyester resin, polyvinyl chloride resin, copolymeric resin of vinyl chloride and other monomer such as vinyl acetate, polyvinyl butyral, polyvinyl pyrrolidone and polycarbonate. Such an image-receiving layer comprises a polymer layer formed of one or not less than two kinds of the above-given polymer binders.

An image-forming element of the invention can be applied to an element capable of recording a full-color image and to an element capable of recording a monochromatic image, by properly selecting a dye that is released from a cobalt complex or a dye that is used as a ligand-exchanging agent.

An image-forming element of the invention may also have a layer such as an interlayer, a protective layer and a sublayer, besides a light-sensitive layer containing a cobalt complex. For recording a full-color image, such an image-forming element as mentioned above is preferred to comprise at least three spectrally sensitized light-sensitive layers.

A spectrally sensitization can be performed by selecting a dye capable of forming a cobalt complex. For making a spectral sensitization, cobalt complexes may be made sensitive to blue, green and red rays of light so that a yellow image, a magenta image and a cyan image may be formed correspondingly to each layer, respectively; or a spectral sensitization may also be carried out in such an order as green, red and infrared, or red, infrared-1 and infrared-2.

An image-forming element of the invention may be exposed to light. For example, sunlight, tungsten light, a mercury lamp, a halogen lamp, a Xenon lamp, laser beam, a light-emission diode and a CRT may be used.

EXAMPLES

Example 1

(Preparation of an image-forming element)

A light-sensitive layer coating solution of the invention was prepared by mixing the following raw materials together.

| | |
|---|---|
| Cobalt complex (1) | 4 g |
| Ligand-exchanging agent (6) | 2 g |
| Polyvinyl butyral resin (BL-1 manufactured by Sekisui Chemical Industrial Co.) | 8 g |
| Methyl ethyl ketone | 100 cc |
| Toluene | 100 cc |

The above-given light-sensitive layer coating solution was coated on a 100 μm-thick polyethylene terephthalate support, by making use of a wire-bar and was then dried up so that the total amount thereof coated was in a proportion of 1.4 g/m$^2$ in the total amount of the components after drying. Thereby, an image-forming element 1 having a light-sensitive layer on a support could be prepared.

Image-forming elements 2 through 5 each of the invention and comparative image-forming elements 6 through 8 were prepared in the same constitution as in image-forming element 1, except that the cobalt complex of the image-forming element 1 was replaced by the following cobalt complexes, respectively. Besides the above, a comparative image-forming element 9 was also prepared by coating thereon a coating solution comprising the coating solution used in comparative image-forming element 8 to which 0.2 g of 2-i-propoxy naphthoquinone was added.

(Image Formation)

Each of the image-forming elements was exposed imagewise to UV rays of light upon superposing an optical wedge thereon. As the UV light source, P-627-HA, produced by Dainihon Screen Co., was used. After completing the exposures and when heating them for 5 seconds at 130° C., elements 1 through 5 of the invention and comparative elements 6 and 9 could each produce the images having a gradation in green on the orangecolored background thereof and, on the other hand, comparative elements 7 and 8 were each proved that they could not form any image at all. The maximum transmission densities (Dmax) and the minimum transmission densities (Dmin) each measured with red light, on each resulting image will be shown below.

After the elements 1 through 6 and 9 were allowed to stand at 55° C. for 5 days, they were exposed to light and heat-developed in the same manners as mentioned above, so that each of the images could be formed. The Dmax and Dmin of the resulting images each measured through red light will also be shown below.

| Image-forming material No. | Cobalt complex | Dmax (in the same day) | Dmin (in the same day) | Dmax (After preserved) | Dmin (After preserved) |
|---|---|---|---|---|---|
| 1 (Invention) | (1) | 0.98 | 0.12 | 0.97 | 0.14 |
| 2 (Invention) | (5) | 0.84 | 0.11 | 0.80 | 0.13 |
| 3 (Invention) | (6) | 0.86 | 0.13 | 0.85 | 0.15 |
| 4 (Invention) | (9) | 0.96 | 0.15 | 0.94 | 0.18 |
| 5 (Invention) | (12) | 0.95 | 0.14 | 0.97 | 0.14 |
| 6 (Comparison) | (C) | 0.68 | 0.11 | 0.69 | 0.12 |
| 7 (Comparison) | (A) | 0.13 | 0.13 | — | — |
| 8 (Comparison) | (B) | 0.12 | 0.12 | — | — |
| 9 (Comparison) | (B) | 0.65 | 0.16 | 0.66 | 0.35 |

Comparative complex-A $Co^{3+}(NH_2CH_2CH_2NH_2)_3(BF_4^{31})_3$

Comparative complex-B $Co^{3+}(NH_2CH_2CH_2NH_2)_3(CF_3COO^-)_3$

Comparative complex-C $Co^{3+}(NH_2CH_2CH_2NH_2)_3(Bph_4^-)_3$

Example 2

In this example, image-forming elements 10 through 12 were each prepared, in which ligand-exchanging agent (6) of image-forming element 1 prepared in Example 1 was replaced by the following ligand-exchanging agent.

On the other hand, image-receiving element 1 was prepared in the following manner. On a paper support laminated with polyethylene on the both sides thereof, a white pigment ($TiO_2$) and a blue colorant were contained in the polyethylene layer on one side thereof, there were each coated with a methylethyl ketone solution of a polyester resin containing the following compound (MS) and ester-modified silicone in a proportion of 0.15 g/m$^2$ as an image-receiving layer so that the proportion of the polyester resin used could be 5 g/m$^2$, and then dried up.

MS

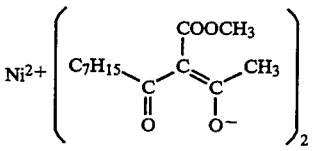

(Image formation)

Image-forming elements 1, 7, 8 and 10 through 12 were each exposed imagewise to Xenon-flash lamp by RISO XENOFAX FX-180 produced by Riso Kagaku-Kogyo Co., upon superposing an optical wedge thereon.

After making the exposure, the image-forming elements were superposed on image-receiving element 1, and they were heated at 100° C. for 5 seconds, respectively. Thereafter, they were further heated at 150° C. for 30 seconds and, when peeling each of the image-receiving elements away, an image corresponding to a ligand-exchanging agent could be so produced as to meet an exposure quantity on every image-receiving element which was superposed thereon with one of the elements 1 and 10 through 12. However, any transferred image corresponding to an exposure quantity could not be produced on comparative elements 7 and 8.

The maximum densities (Dmax) and the minimum densities (Dmin) and the image colors of the color images resulted from the image-forming materials will be shown below.

| Image-forming material No. | Ligand-exchanging agent | Dmax | Dmin | Image color |
|---|---|---|---|---|
| 1 (Invention) | (6) | 1.19 | 0.26 | Magenta |
| 10 (Invention) | (5) | 0.93 | 0.22 | Magenta |
| 11 (Invention) | (8) | 0.78 | 0.23 | Yellow |
| 12 (Invention) | (9) | 0.76 | 0.20 | Cyan |
| 7 (Comparison) | (6) | 0.26 | 0.26 | Magenta |
| 8 (Comparison) | (6) | 0.25 | 0.25 | Magenta |

Example 3

A light-sensitive layer coating solution of the invention was prepared by mixing the following raw materials.

| | |
|---|---|
| Cobalt complex (16) | 3 g |

-continued

| | |
|---|---|
| Ligand-exchanging agent (4) | 3 g |
| Polyvinyl butyral resin (BL-1, manufactured by Sekisui Chemical Ind. Co.) | 8 g |
| Methyl ethyl ketone | 100 cc |
| Toluene | 100 cc |

On the same support as that used in Example 1, the above-given light-sensitive layer coating solution was coated, by making use of a wire-bar, so that the proportion of the coating solution is 1.4 g/m$^2$ in the total weight of the components after dried up, and then dried. Resultingly, an image-forming element 13 having a light-sensitive layer on the support thereof was prepared. Besides, the image-forming elements of the invention 14 through 16 and the comparative image-forming elements 17 and 18 were each prepared by making use of the following combination in place of the combination of the cobalt complex and ligand-exchanging agent for image-forming element 13. Each of the resulting image-forming elements was exposed with scanning to a semiconductor laser beam having a wavelength of 820 nm. At that time, the exposure energy applied onto each image-forming material was 0.5 mJ/cm$^2$. After making the exposures, when heating them in the same manner as in Example 1, the elements of the invention 13 through 16 could produce the cyan images corresponding to the exposed portions, respectively. In contrast to the above, the comparative elements 17 and 18 could not be proved at all to form any image.

Separate from the above, the image-forming elements 13 through 16 were each preserved at 55° C. for 5 days and when they were exposed to light and then developed, the cyan images each corresponding to the exposed portions could be produced with the same exposure energies as those before preserving them, and any increasing fog production could not be observed both before and after the preservation thereof.

| Image-forming material No. | Cobalt-complex | Ligand-exchanging agent |
|---|---|---|
| 13 (Invention) | (16) | (4) |
| 14 (Invention) | (16) | (2) |
| 15 (Invention) | (19) | (2) |
| 16 (Invention) | (21) | (4) |
| 17 (Comparison) | (D) | (2) |
| 18 (Comparison) | (E) | (2) |

Comparative complex-D

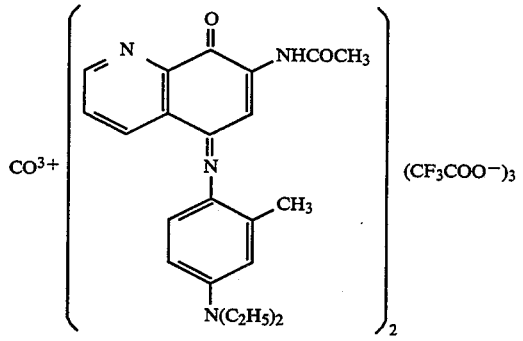

Comparative comples-E

-continued

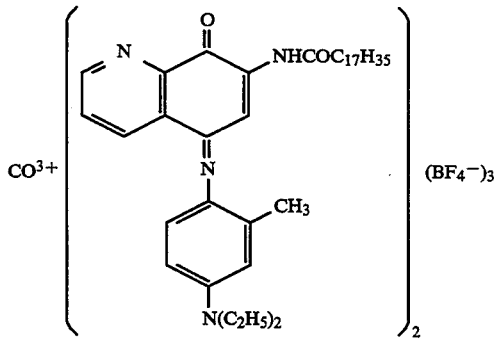

Example 4

After the image-forming elements 12 through 15 prepared in Example 3 were exposed to laser beam in the same manner as in Example 3, they were superposed on the image-receiving element 2 having the following composition and, when they were then heated at 130° C. for 30 seconds and then developed, the cyan images were formed respectively on the portions of the image-receiving elements corresponding to the portions of the image-forming elements exposed with scanning.

Image-receiving material 2

Image-receiving material 2 was used upon preparing it in the following manner. On a paper support laminated with polyethylene on the both sides thereof, a white pigment ($TiO_2$) and a blue colorant were contained in the polyethylene layer on one side thereof), the support was coated thereon with a methylethyl ketone solution of a polyvinyl butyral resin containing an ester-modified silicone in a proportion of 0.15 g/m$^2$ as an image-receiving layer so that the proportion of the polyester resin used could be 5 g/m$^2$, and then dried up.

What is claimed is:

1. An image forming element comprising a support having thereon a light-sensitive layer consisting essentially of a binder, a cobalt complex compound represented by Formula 1 or Formula 2 and a ligand exchanging agent capable of forming a complex compound with a cobalt cation provided that one of said cobalt complex compound and said ligand exchanging agent has a moiety of dye or a dye precursor;

$$[CO^{3+}(lig)_m]\left(R^4-\overset{\overset{R^1}{|}}{\underset{\underset{R^3}{|}}{B}}-R^2\right)_n(X)_s \quad (1)$$

wherein lig is a coordination compound capable of forming a cobalt complex compound with a cobalt cation; $R^1$, $R^2$, $R^3$ and $R^4$ are each independently an aryl group, an alkyl group, an alkenyl group, an alkynyl group, a cycloalkyl group, an aralkyl group, a heterocyclic group or a cyano group, provided that at least one of $R^1$, $R^2$, $R^3$ and $R^4$ is an alkyl group, an alkenyl group, an alkynyl group, a cycloalkyl group, an aralkyl group, a heterocyclic group or a cyano group, the above groups represented by by $R^1$, $R^2$, $R^3$ and $R^4$ are each independently a substituted or unsubstituted group, wherein when $R^1$, $R^2$, $R^3$ and $R^4$ are each independently substituted groups, said groups are substituted with a halogen atom, cyano, nitro, alkyl, aryl, hydroxy, amino, alkyl-substituted amino, alkoxy, carbamoyl, —COOR$^9$ or OCOR$^9$ group, wherein R$^9$ is an alkyl or aryl group; X is a monovalent or bivalent anion; m is 1, 2 or 3, when m is 2 or 3, a plurality of lig's are the same or different; n is 1, 2 or 3; and s is 0, 1 or 2; and m, n and s are selected so that the valence of the cobalt complex compound is zero;

$$[CO^{3+}(Dlig)_p]\left(R^8-\overset{\overset{R^5}{|}}{\underset{\underset{R^7}{|}}{B}}-R^6\right)_q(X)_r \quad (2)$$

wherein Dlig is a coordination compound capable of forming a cobalt complex compound with a cobalt cation; p is 1, 2 or 3, when p is 2 or 3 a plurality of Dlig's are the same or different, provided that at least one of the Dlig's is a coordination compound having a moiety of a dye or a moiety of a dye precursor; $R^5$, $R^6$, $R^7$ and $R^8$ are each independently an aryl group, an alkyl group, an alkenyl group, an alkynyl group, a cycloalkyl group, an aralkyl group, a heterocyclic group or a cyano group, the groups represented by $R^5$, $R^6$, $R^7$ and $R^8$ are each independently a substituted or unsubstituted group, wherein when $R^5$, $R^6$, $R^7$ and $R^8$ are each independently substituted groups, said groups are substituted with a halogen atom, cyano, nitro, alkyl, aryl, hydroxy, amino, alkoxy, carbamoyl, —COOR$^9$ or OCOR$^9$ group, wherein R$^9$ is an alkyl or aryl group; q is 1, 2 or 3; X is a monovalent or bivalent anion; r is 0, 1 or 2; and p, q and r are selected so that the valence of the cobalt complex compound is zero.

2. The element of claim 1, wherein said compound is a compound represented by Formula 1 in which $R^1$ is an alkyl group or an aralkyl group, and $R^2$, $R^3$ and $R^4$ are each an aryl group or a heterocyclic group.

3. The element of claim 1, wherein the alkyl group represented by $R^1$, $R^2$, $R^3$ or $R^4$ of Formula 1 is a methyl group, an ethyl group, a butyl group, an i-butyl group, a hexyl group, an octyl group or a stearyl group.

4. The element of claim 1, wherein the alkenyl group or alkynyl group represented by $R^1$, $R^2$, $R^3$ or $R^4$ of Formula 1 is an alkenyl group or an alkynyl group each having 2 to 20 carbon atoms.

5. The element of claim 1, wherein the cycloalkyl group represented by $R^1$, $R^2$, $R^3$ or $R^4$ of Formula 1 is a five-, six- or seven-member cycloalkyl group.

6. The element of claim 1, wherein the aralkyl group represented by $R^1$, $R^2$, $R^3$ or $R^4$ of Formula 1 is a benzyl group.

7. The element of claim 1, wherein the heterocyclic group represented by $R^1$, $R^2$, $R^3$ or $R^4$ of Formula 1 is a heterocyclic group having an aromaticity.

8. The element of claim 1, wherein the aryl group represented by $R^1$, $R^2$, $R^3$ or $R^4$ of Formula 1 is a phenyl group or a naphthyl group.

9. The element of claim 1, wherein a group to be the substituent of the group represented by $R^1$, $R^2$, $R^3$ or $R^4$ of Formula 1 is a halogen atom, a cyano group, a nitro group, an alkyl group, an aryl group, a hydroxyl group, an amino group, an alkoxyl group, a carbamoyl group, a —COOR$_9$ group or an —OCOR$_9$ in which R$_9$ is an organic group.

10. The element of claim 1, wherein said compound is a compound represented by Formula 2 in which $R^5$ is an alkyl group or an aralkyl group, and $R^6$, $R^7$ and $R^8$ are each an aryl group or a heterocyclic group.

11. The element of claim 1, wherein the alkyl group represented by $R_5$, $R_6$, $R^7$ or $R^8$ of Formula 2 is a methyl group, an ethyl group, a butyl group, an i-butyl group, a hexyl group, an octyl group or a stearyl group.

12. The element of claim 1, wherein the alkenyl group or alkynyl group represented by $R_5$, $R_6$, $R^7$ or $R^8$ of Formula 2 is an alkenyl group or an alkynyl group each having 2 to 20 carbon atoms.

13. The element of claim 1, wherein the cycloalkyl group represented by $R_5$, $R_6$, $R^7$ or $R^8$ of Formula 2 is a five-, six- or seven-member cycloalkyl group.

14. The element of claim 1, wherein the aralkyl group represented by $R_5$, $R_6$, $R^7$ or $R^8$ of Formula 2 is a benzyl group.

15. The element of claim 1, wherein the heterocyclic group represented by $R_5$, $R_6$, $R^7$ or $R^8$ of Formula 2 is a heterocyclic group having an aromaticity.

16. The element of claim 1, wherein the aryl group represented by $R_5$, $R_6$, $R^7$ or $R^8$ of Formula 2 is a phenyl group or a naphthyl group.

17. The element of claim 1, wherein a group to be the substituent of the group represented by $R_5$, $R_6$, $R^7$ or $R^8$ of Formula 2 is a halogen atom, a cyano group, a nitro group, an alkyl group, an aryl group, a hydroxyl group, an amino group, an alkoxyl group, a carbamoyl group, a —$COOR_9$ group or an —$OCOR_9$ in which $R_9$ is an organic group.

18. The element of claim 1, wherein the cobalt cation of Formula 1 or Formula 2 is a Lewis acid and the coordination compound is a Lewis base.

19. The element of claim 1, wherein said binder is acrylic resin, methacrylic resin, polystyrene, polycarbonate, polysulfone, polyethersulfone, polyvinyl butyral, polyvinyl acetal, nitrocellulose or ethyl cellulose.

20. The element of claim 1, wherein said ligand exchanging agent is selected from the group consisting of:

$NH_2CH_2CH_2NH_2$, $NH_2CH_2CONH_2$,

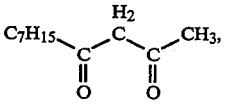

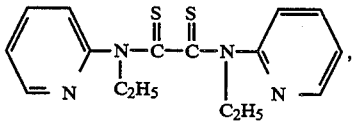

-continued

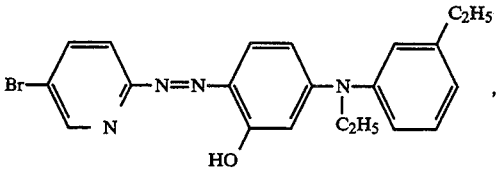

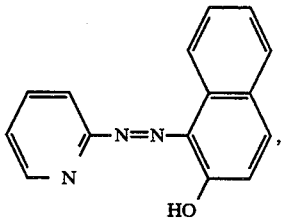

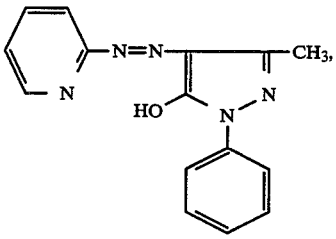

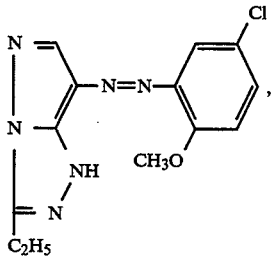

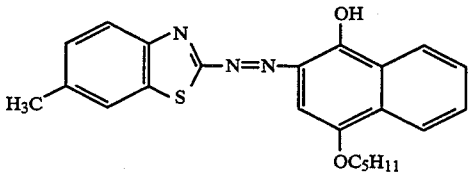

and

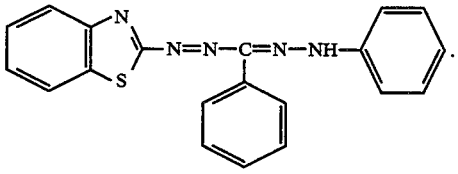

21. The element of claim 20 wherein said cobalt complex is selected from the group consisting of complexes numbered 1–31 defined below:

| Complex No. | $R^1$ | $R^2$ | $R^3$ | $R^4$ |
|---|---|---|---|---|

$$CO^{3+}(NH_2CH_2CH_2NH_2)_3\left(R^4-\overset{\overset{R^1}{|}}{\underset{\underset{R^3}{|}}{B}}-R^2\right)_3$$

-continued

| | | | | |
|---|---|---|---|---|
| 1 | $-C_4H_9$ | 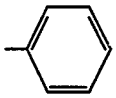 | 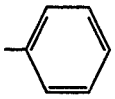 | 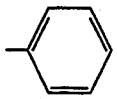 |
| 2 | $-C_4H_9$ | $-C_4H_9$ | $-C_4H_9$ | $-C_4H_9$ |
| 3 | $-C_4H_9$ | 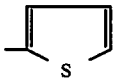 | 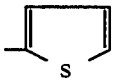 | 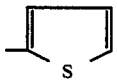 |
| 4 | $-C_4H_9(i)$ | 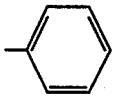 | 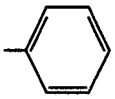 | 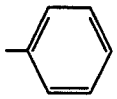 |
| 5 | 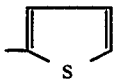 | 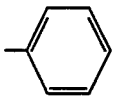 | 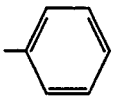 | 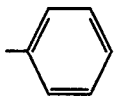 |

$$CO^{3+}(NH_2CH_2CONH_2)_3\left(R^4-\overset{\overset{R^1}{|}}{\underset{\underset{R^3}{|}}{B}}^{-}-R^2\right)_3$$

| | | | | |
|---|---|---|---|---|
| 6 | $-C_4H_9$ | 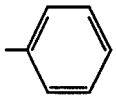 | 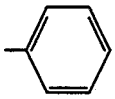 | 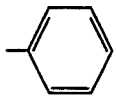 |
| 7 | $-C_4H_9$ | 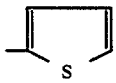 | 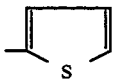 | 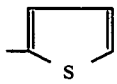 |

$$CO^{3+}(NH_2CH_2CH_2NHCH_2CH_2NH_2)_3\left(R^4-\overset{\overset{R^1}{|}}{\underset{\underset{R^3}{|}}{B}}^{-}-R^2\right)_3$$

| | | | | |
|---|---|---|---|---|
| 8 | $-C_4H_9$ | 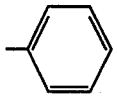 | 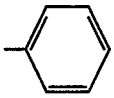 | 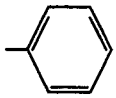 |
| 9 | $-C_4H_9$ | $-C_4H_9$ | $-C_4H_9$ | $-C_4H_9$ |
| 10 | $-C_4H_9(i)$ | 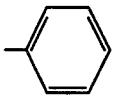 | 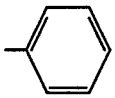 | 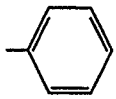 |
| 11 | 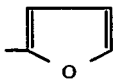 | 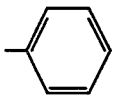 | 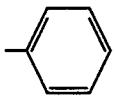 | 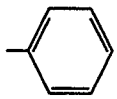 |

$$CO^{3+}\left(\text{N}\!-\!\text{C}_5\text{H}_4\!-\!\text{C}_5\text{H}_4\!-\!\text{N}\right)_3\left(R^4-\overset{\overset{R^1}{|}}{\underset{\underset{R^3}{|}}{B}}^{-}-R^2\right)_3$$

-continued
| | | | | |
|---|---|---|---|---|
| 12 | $-C_4H_9$ | 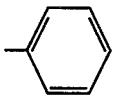 | 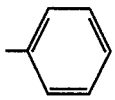 | 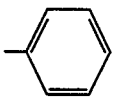 |
| 13 | $-C_4H_9$ | $-C_4H_9$ | $-C_4H_9$ | $-C_4H_9$ |
| 14 | $-C_4H_9$ | 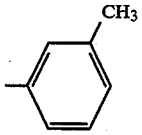 | 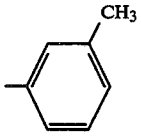 | 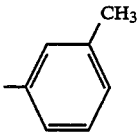 |
| 15 | 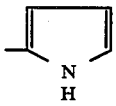 | 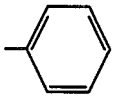 | 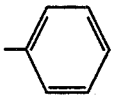 | 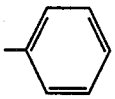 |
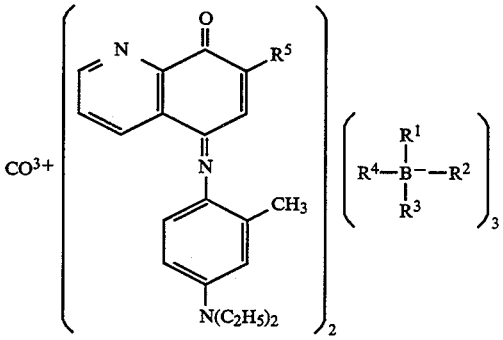
| Complex No. | $R^5$ | $R^1$ | $R^2$ | $R^3$ | $R^4$ |
|---|---|---|---|---|---|
| 16 | H | $-C_4H_9$ | 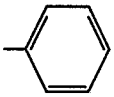 | 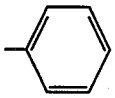 | 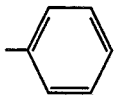 |
| 17 | H | $-C_4H_9$ | $-C_4H_9$ | $-C_4H_9$ | $-C_4H_9$ |
| 18 | H | $-C_4H_9$ | 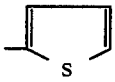 | 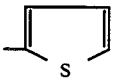 | 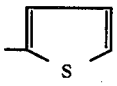 |
| 19 | H | $-C_4H_9(i)$ | 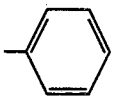 | 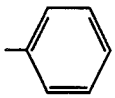 | 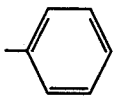 |
| 20 | $-NHCOCH_3$ | $-C_4H_9$ | 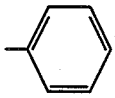 | 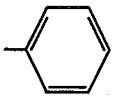 | 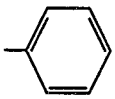 |
| 21 | Cl | $-C_4H_9$ | 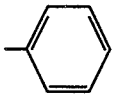 | 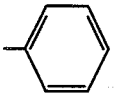 | 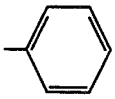 |
| 22 | $-NHCOC_{17}H_{35}$ | $-C_4H_9$ | 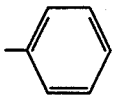 | 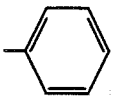 | 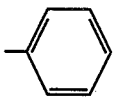 |
| Complex No. | $R^1$ | $R^2$ | $R^3$ | $R^4$ |
|---|---|---|---|---|

-continued
| | | | | |
|---|---|---|---|---|
| $CO^{3+}(NH_2CH_2CH_2NH_2)_2NH_2CH_2CH_2NH$ | 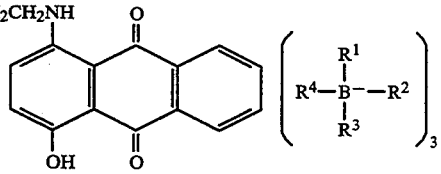 | | |  |
| 23 | $-C_4H_9$ | 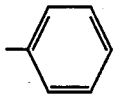 | 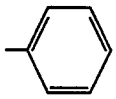 | 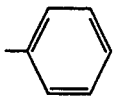 |
| 24 | $-C_4H_9$ | $-C_4H_9$ | $-C_4H_9$ | $-C_4H_9$ |
| 25 | $-C_4H_9$ | 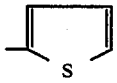 | 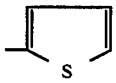 | 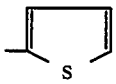 |
| 26 | $-C_4H_9(i)$ | 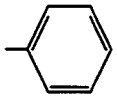 | 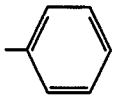 | 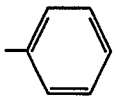 |
| 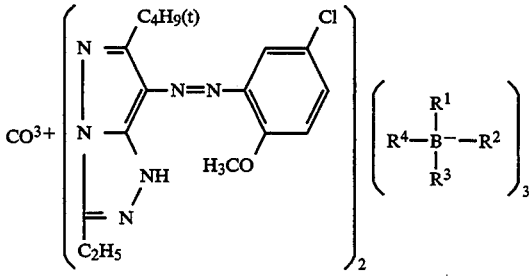 | | | | |
| 27 | $-C_4H_9$ | 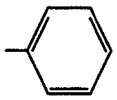 | 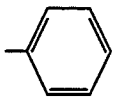 | 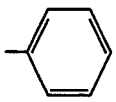 |
| 28 | $-C_4H_9$ | $-C_4H_9$ | $-C_4H_9$ | $-C_4H_9$ |
| 29 | $-C_4H_9$ | 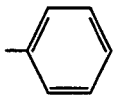 | 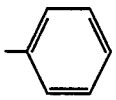 | 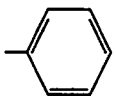 |
| 30 | $[Co^{3+}(NH_2CH_2CH_2NH_2)_3](BuB^-Ph_3)_2Cl^-$ | | | |
| 31 | $[Co^{3+}(NH_2CH_2CH_2NH_2)_3](BuB^-Ph_3)(CF_3COO^-)_2$ | | | |
Wherein, in the above complex 30 and 31, Bu is a butyl group and Ph is a phenyl group.
* * * * *